US010565949B2

(12) United States Patent
Zou et al.

(10) Patent No.: US 10,565,949 B2
(45) Date of Patent: Feb. 18, 2020

(54) LIQUID CRYSTAL DISPLAY, TURNOFF DISCHARGE CIRCUIT OF LIQUID CRYSTAL DISPLAY AND DRIVING METHOD THEREOF

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Yifeng Zou, Beijing (CN); Qiang Liu, Beijing (CN); Mindong Zheng, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 16/171,155

(22) Filed: Oct. 25, 2018

(65) Prior Publication Data

US 2019/0304391 A1 Oct. 3, 2019

(30) Foreign Application Priority Data

Mar. 30, 2018 (CN) ..... 2018 1 0292545

(51) Int. Cl.
*G09G 3/36* (2006.01)

(52) U.S. Cl.
CPC ... *G09G 3/3648* (2013.01); *G09G 2300/0426* (2013.01); *G09G 2300/0452* (2013.01); *G09G 2330/027* (2013.01)

(58) Field of Classification Search
CPC ..... G09G 3/3648; G09G 2330/027; G09G 2300/0452; G09G 2300/0426
See application file for complete search history.

(56) References Cited

U.S. PATENT DOCUMENTS

2002/0080133 A1* 6/2002 Eu ..... G09G 3/3648 345/212
2008/0001905 A1* 1/2008 Wu ..... G09G 3/3648 345/100

(Continued)

*Primary Examiner* — Abhishek Sarma
(74) *Attorney, Agent, or Firm* — Kinney & Lange, P.A.

(57) ABSTRACT

The present disclosure provides a liquid crystal display, a turnoff discharge circuit of a liquid crystal display and a driving method thereof. The liquid crystal display includes a plurality of pixel units distributed in an array, each column of pixel units being connected to a data line. The turnoff discharge circuit includes: a power storage circuit, having a first end grounded; a discharge circuit, having a first end grounded and a second end connected to a data line corresponding to each column of the pixel units; and a discharge control circuit, wherein the discharge control circuit is connected to a second end of the power storage circuit and to a control end of the discharge circuit; wherein in response to receiving a turnoff signal of the liquid crystal display, the discharge control circuit controls the discharge circuit to operate in order to discharge each of the pixel units through the discharge circuit, and controls the power storage circuit to charge, wherein after the turnoff signal ends, the power storage circuit discharges to keep the discharge circuit in an operating state, so that each of the pixel units continues discharging through the discharge circuit.

11 Claims, 4 Drawing Sheets

(56) References Cited

U.S. PATENT DOCUMENTS

| | | | | |
|---|---|---|---|---|
| 2008/0100331 | A1* | 5/2008 | Qi | G09G 3/3648<br>324/750.3 |
| 2008/0309306 | A1* | 12/2008 | Huang | G09G 3/3696<br>323/303 |
| 2009/0066684 | A1* | 3/2009 | Lee | G09G 3/3648<br>345/211 |
| 2010/0182305 | A1* | 7/2010 | Fang | G09G 3/3677<br>345/212 |

* cited by examiner

LIQUID CRYSTAL DISPLAY, TURNOFF DISCHARGE CIRCUIT OF LIQUID CRYSTAL DISPLAY AND DRIVING METHOD THEREOF

CROSS-REFERENCE TO RELATED APPLICATION

This application claims priority to Chinese Application No. 201810292545.2, entitled "LIQUID CRYSTAL DISPLAY, TURNOFF DISCHARGE CIRCUIT OF LIQUID CRYSTAL DISPLAY AND DRIVING METHOD THEREOF" and filed on Mar. 30, 2018, which is incorporated herein by reference in its entirety.

BACKGROUND

The present disclosure relates to the field of liquid crystal display technology, and in particular to a turnoff discharge circuit of a liquid crystal display, a liquid crystal display and a method of driving a turnoff discharge circuit of a liquid crystal display.

A liquid crystal display is a display technology that displays by using a characteristic of liquid crystals which deflect under an electric field. Liquid crystal displays have numerous advantages, including low-voltage drive, flat structure, large capacity for display information, easy colorization, long service life, lack of radiation, and lack of pollution. These features have made liquid crystal displays the most popular type of display technology. A liquid crystal display is composed of pixel units distributed in an array. During a display process, a gate driving circuit is configured to generate a gate scanning voltage for the pixel units, and a gate driving signal is output from the gate driving circuit to perform progressive scanning on each row of pixel units.

SUMMARY

An embodiment according to a first aspect of the present disclosure provides a turnoff discharge circuit of a liquid crystal display, the liquid crystal display including a plurality of pixel units distributed in an array, each column of pixel units being connected to a data line, the turnoff discharge circuit including: a power storage circuit, having a first end grounded; a discharge circuit, having a first end grounded and a second end connected to a data line corresponding to each column of the pixel units; and a discharge control circuit, wherein the discharge control circuit is connected to a second end of the power storage circuit and to a control end of the discharge circuit; wherein in response to receiving a turnoff signal of the liquid crystal display, the discharge control circuit controls the discharge circuit to operate in order to discharge each of the pixel units through the discharge circuit, and controls the power storage circuit to charge, wherein after the turnoff signal ends, the power storage circuit discharges and keeps the discharge circuit in an operating state, so that each of the pixel units continues discharging through the discharge circuit.

According to an embodiment of the present disclosure, the discharge control circuit is further configured to keep the discharge circuit in a non-operating state in response to receiving a display signal of the liquid crystal display.

According to an embodiment of the present disclosure, the power storage circuit includes: a power storage capacitor, having a first end grounded and a second end connected to the discharge control circuit.

According to an embodiment of the present disclosure, the power storage circuit includes: a power storage capacitor, having a first end grounded and a second end connected to the discharge control circuit.

According to an embodiment of the present disclosure, the discharge circuit includes: a first discharge switch sub-circuit, having a first end grounded and a control end connected to the discharge control circuit; a second discharge switch sub-circuit, having a first end connected to a second end of the first discharge switch sub-circuit, a second end connected to a data line corresponding to each column of the pixel units, and a control end connected to the discharge control circuit, wherein in response to receiving the turnoff signal of the liquid crystal display, the discharge control circuit controls the first discharge switch sub-circuit and the second discharge switch sub-circuit to be turned on to discharge each of the pixel units.

According to an embodiment of the present disclosure, the plurality of pixel units distributed in the array are circularly arranged in an order of a red pixel unit column, a green pixel unit column, and a blue pixel unit column sequentially, wherein the second discharge switch sub-circuit includes a first transistor corresponding to the red pixel unit column, a second transistor corresponding to the green pixel unit column, and a third transistor corresponding to the blue pixel unit column, wherein each of the first transistors has a first electrode connected to a data line corresponding to the red pixel unit column, a control electrode connected to the discharge control circuit, and a second electrode connected to a first node; each of the second transistors has a first electrode connected to a data line corresponding to the green pixel unit column, a control electrode connected to the discharge control circuit, and a second electrode connected to a second node; and each of the third transistors has a first electrode connected to a data line corresponding to the blue pixel unit column, a control electrode connected to the discharge control circuit, and a second electrode connected to a third node.

According to an embodiment of the present disclosure, the first discharge switch sub-circuit includes: a fourth transistor, having a first electrode grounded, a second electrode connected to the second node, and a control electrode connected to the discharge control circuit; a fifth transistor, having a first electrode grounded, a second electrode connected to the third node, and a control electrode connected to the discharge control circuit; and a sixth transistor, having a first electrode grounded, a second electrode connected to the first node, and a control electrode connected to the discharge control circuit.

An embodiment according to a second aspect of the present disclosure provides a liquid crystal display including the turnoff discharge circuit of the liquid crystal display as described above.

An embodiment according to a third aspect of the present disclosure provides a method of driving a turnoff discharge circuit of a liquid crystal display, the liquid crystal display including a plurality of pixel units distributed in an array, each column of pixel units being connected to a data line, the turnoff discharge circuit including: a power storage circuit, having a first end grounded; a discharge circuit, having a first end grounded and a second end connected to a data line corresponding to each column of the pixel units; and a discharge control circuit, connected to a second end of the power storage circuit and to a control end of the discharge circuit, the method including: in response to receiving a turnoff signal of the liquid crystal display, the discharge control circuit controlling the discharge circuit to operate in order to discharge each of the pixel units through the discharge circuit, and controlling the power storage circuit to charge; and after the turnoff signal ends, the power storage circuit discharging and keeping the discharge circuit in an operating state, so that each of the pixel units continues discharging through the discharge circuit.

According to an embodiment of the present disclosure, the method of driving the turnoff discharge circuit of the liquid crystal display further includes: the discharge control circuit keeping the discharge circuit in a non-operating state in response to receiving a display signal of the liquid crystal display.

According to an embodiment of the present disclosure, the discharge control circuit outputs a first level in response to receiving the display signal of the liquid crystal display; and the discharge control circuit outputs a second level in response to receiving a turnoff signal of the liquid crystal display, wherein the first level is complementary with the second level.

The additional aspects and advantages of the present disclosure will be set forth in part in the following description, a part of which will be obvious from the following description, or learned from practice of the present disclosure.

DETAILED DESCRIPTION

Figure 1:
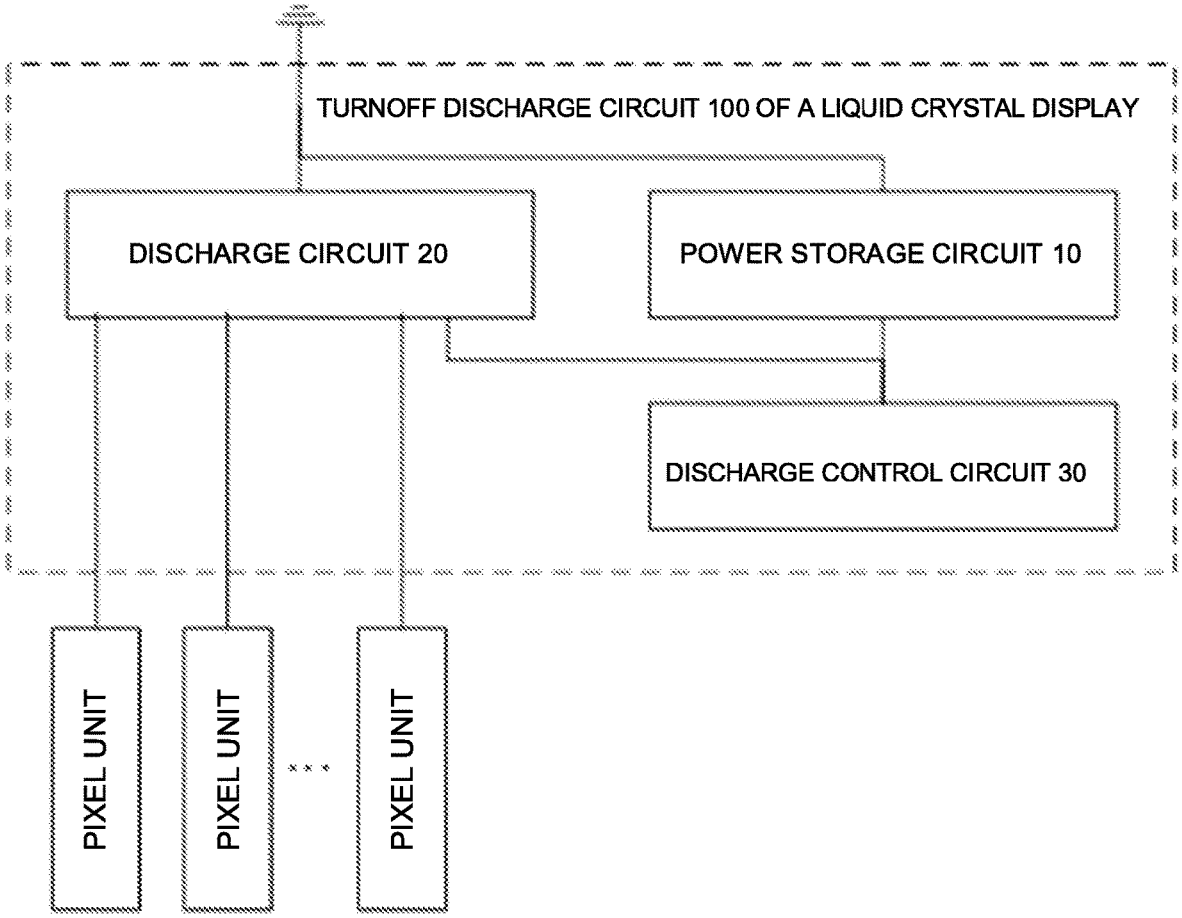
FIG. 1 is a schematic structural diagram of a turnoff discharge circuit of a liquid crystal display according to an embodiment of the present disclosure.

The embodiments of the present disclosure are described in detail below, and examples of the embodiments are illustrated in the drawings, wherein the same or similar reference numerals are used to refer to the same or similar elements or elements having the same or similar functions. The embodiments described below with reference to the accompanying drawings are intended to be illustrative, but are not to be construed as limiting the present disclosure.

In order to make the display picture uniform, when the liquid crystal display is turned off, an off voltage VGL applied to a gate of each pixel unit is instantaneously pulled up to VGH to turn all TFTs (Thin Film Transistors) on, so that positive and negative voltages of the whole liquid crystal display are neutralized, finally ensuring uniformity of the picture display.

Currently, however, most liquid crystal display technologies use positive voltage driving, i.e., all Gamma voltages are above 0V, thus after the liquid crystal display is turned off, the voltage of each pixel unit of the whole liquid crystal display is still not 0V although it is in a uniform state. That is, after a common voltage Vcom drops to 0V after the liquid crystal display is completely turned off, there is still a voltage difference between the voltage of each pixel unit and Vcom, so that the liquid crystal is deflected to generate polarization, which affects the display of the subsequent liquid crystal display. To this end, the present disclosure proposes a turnoff discharge circuit of a liquid crystal display.

FIG. 1 is a schematic structural diagram of a turnoff discharge circuit of a liquid crystal display according to an embodiment of the present disclosure.

In an embodiment of the present disclosure, the liquid crystal display includes a plurality of pixel units distributed in an array, each column of pixel units being connected to a data line.

As shown in FIG. 1, the turnoff discharge circuit 100 includes a power storage circuit 10, a discharge circuit 20 and a discharge control circuit 30. A first end of the storage circuit 10 is grounded. The discharge circuit 20 has a first end grounded, and a second end connected to the data line corresponding to each column of pixel units. The discharge control circuit 30 is connected to a second end of the power storage circuit 10 and to a control terminal of the discharge circuit 20, respectively.

Specifically, in response to receiving a turnoff signal of the liquid crystal display, the discharge control circuit 30 controls the discharge circuit 20 to operate in order to discharge each pixel unit through the discharge circuit 20, and controls the power storage circuit 10 to charge. After the turnoff signal ends, the power storage circuit 10 discharges, and keeps the discharge circuit 20 in an operating state, so that each of the pixel units continues discharging through the discharge circuit 20.

In an embodiment of the present disclosure, the discharge control circuit 30 is further configured to keep the discharge circuit 20 in a non-operating state in response to receiving a display signal of the liquid crystal display, so that an effective display area of the liquid crystal display is normally displayed.

Figure 2:
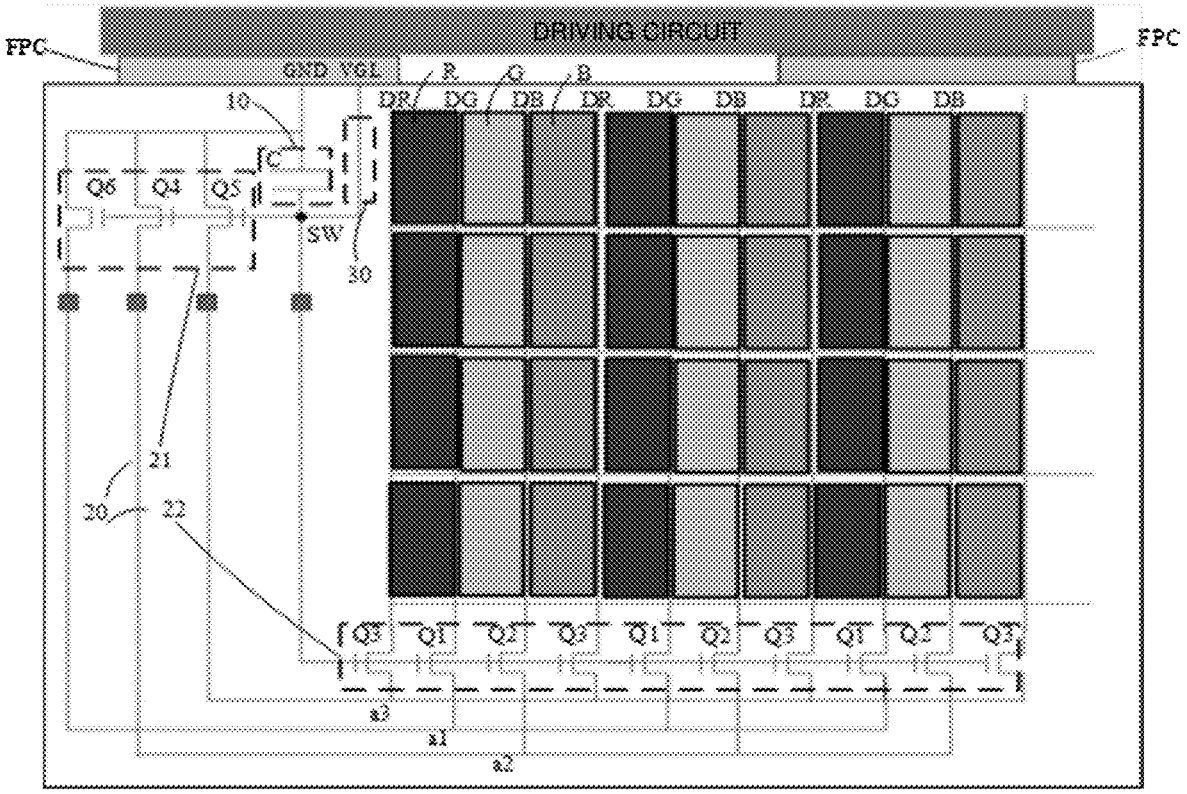
FIG. 2 is a circuit diagram of a turnoff discharge circuit of a liquid crystal display according to a particular example of the present disclosure.

In a particular embodiment of the present disclosure, as shown in FIG. 2, the power storage circuit 10 includes a power storage capacitor C. The power storage capacitor C has a first end grounded, and a second end connected to an output end SW of the discharge control circuit 30.

Further, as shown in FIG. 2, the discharge circuit 20 includes a first discharge switch sub-circuit 21 and a second discharge switch sub-circuit 22. The first discharge switch sub-circuit 21 has a first end grounded, and a control end connected to the output end SW of the discharge control circuit 30. The second discharge switch sub-circuit 22 has a first end connected to the second end of the discharge switch sub-circuit 21, a second end connected to the data line corresponding to each column of pixel units, and a control end connected to the output end SW of the discharge control circuit 30.

In the present embodiment, in response to receiving a turnoff signal of the liquid crystal display, the discharge control circuit 30 controls the first discharge switch sub-circuit 21 and the second discharge switch sub-circuit 22 to be turned on, so as to discharge each pixel unit.

Specifically, as shown in FIG. 2, the plurality of pixel units distributed in the array are circularly arranged in an order of a red pixel unit column R, a green pixel unit column G and a blue pixel unit column B sequentially, wherein the second discharge switch sub-circuit 22 includes a first transistor Q1 corresponding to the red pixel unit column R, a second transistor Q2 corresponding to the green pixel unit column G, and a third transistor Q3 corresponding to the blue pixel unit column B. Each first transistor Q1 has a first electrode connected to a data line DR corresponding to the red pixel unit column R, a control electrode connected to the output end SW of the discharge control circuit 30, and a second electrode connected to a first node a1. Each second transistor Q2 has a first electrode connected to a data line DG corresponding to the green pixel unit column G, a control electrode connected to the output end SW of the discharge control circuit 30, and a second electrode connected to a second node a2. Each third transistor Q3 has a first electrode connected to a data line DB corresponding to the blue pixel unit column B, a control electrode connected to the output end SW of the discharge control circuit 30, and a second electrode connected to a third node a3.

As shown in FIG. 2, the first discharge switch sub-circuit 21 includes a fourth transistor Q4, a fifth transistor Q5, and a sixth transistor Q6. The fourth transistor Q4 has a first electrode grounded, a second electrode connected to the second node a2, and a control electrode connected to the output end SW of the discharge control circuit 30. The fifth transistor Q5 has a first electrode grounded, a second electrode connected to a third node a3, and a control electrode connected to the output end SW of the discharge control circuit 30. The sixth transistor Q6 has a first electrode grounded, a second electrode connected to the first node a1, and a control electrode connected to the output end SW of the discharge control circuit 30.

The transistors Q1 to Q6 may each be a TFT. It should be understood that the control electrode of each transistor is the gate of the TFT, and if the first electrode of the transistor is the source, the second electrode of the transistor is the drain; while if the second electrode of the transistor is the source, the first electrode of the transistor is the drain.

It should be noted that a link in the turnoff discharge circuit 100 in the present embodiment can utilize a trace reserved when the liquid crystal display is designed, thereby improving utilization of a PLG (Propel Link Gate) trace in the liquid crystal display.

In addition, it should be understood that, as shown in FIG. 2, the driving circuit is connected to the pixel units and the turnoff discharge circuit 100 through an FPC (Flexible Printed Circuit) to provide corresponding signals to the pixel units and the turnoff discharge circuit 100. Each of four blocks on the links between the second discharge switch sub-circuit 22 and the first discharge switch sub-circuit 21 in FIG. 2 represents a test point reserved in the liquid crystal display to facilitate the test of the liquid crystal display.

Figure 3:
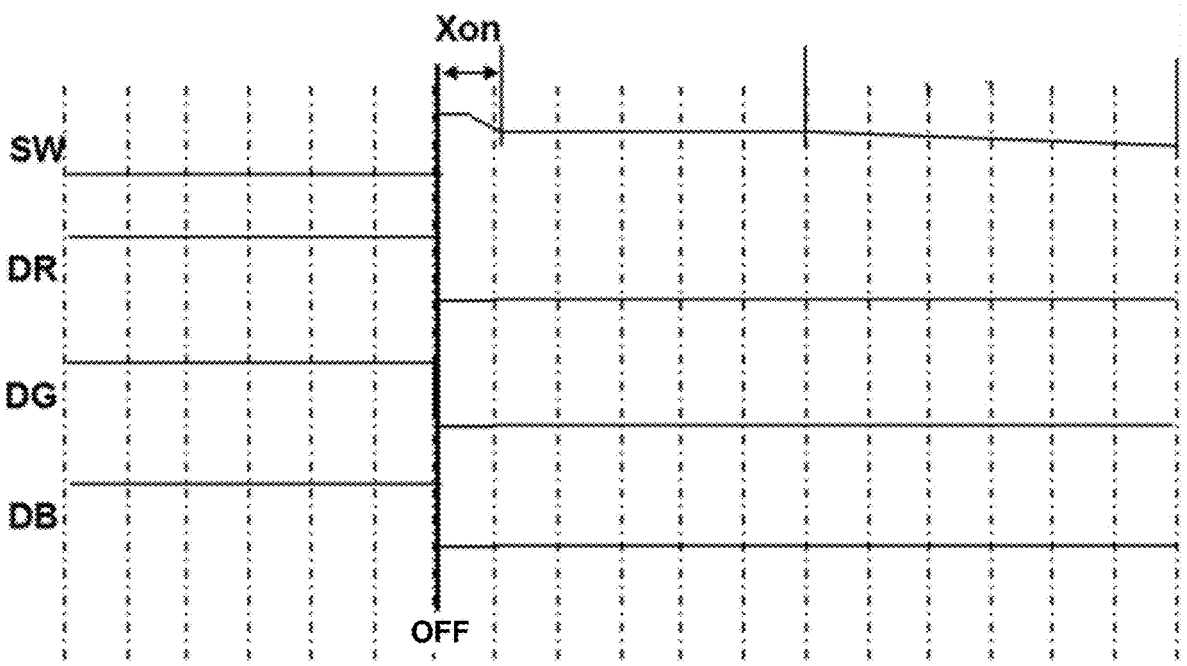
FIG. 3 is a control timing diagram of a turnoff discharge circuit as shown in FIG. 2.

An operation principle of the turnoff discharge circuit as shown in FIG. 2 will be described below with reference to the timing diagram as shown in FIG. 3.

As shown in FIG. 2 and FIG. 3, when the liquid crystal display displays normally, the discharge control circuit 30 receives the display signal of the liquid crystal display. At this time, the output end SW of the discharge control circuit 30 outputs a low voltage signal VGL, and the transistors Q1 to Q6 are all at the OFF state, the discharge circuit 20 does not operate, and the data lines of the respective pixel units are not connected to the ground, thereby ensuring the normal display of the AA area (Active Area, i.e., an effective display area).

When the liquid crystal display is turned off, the liquid crystal display outputs a turnoff signal Xon, and the VGL is pulled up to a high voltage signal VGH, so that the output end SW of the discharge control circuit 30 outputs a high-level signal VGH. At this time, the transistors Q1 to Q6 are all in an ON state, the data lines DR, DG and DB are connected to the ground, and each pixel unit is connected to the ground and directly discharges to the ground. At the same time, when the output end SW of the discharge control circuit 30 outputs the high-level signal VGH, the storage capacitor C is charged.

When the turnoff signal Xon ends, the power storage capacitor C is discharged due to the power storage effect of the power storage capacitor C, so that the output end SW of the discharge control circuit 30 (i.e., the second end of the power storage capacitor C) is kept at the high level for a period of time, and the transistors Q1 to Q6 are still in the ON state, so that each pixel unit is discharged to the ground until the voltage of the second end of the storage capacitor C is lower than the on-voltage of the transistors. As such, each pixel unit may be sufficiently discharged.

In summary, with respect to the problem in the prior art that there is a voltage difference between the voltage of the pixel unit and the Vcom after the liquid crystal display is turned off, the turnoff discharge circuit according to the embodiment of the present disclosure may discharge all the pixel units when the liquid crystal display is turned off, and the power storage circuit continues discharging the pixel units after the turnoff signal ends, so that the data line of each pixel unit is connected to the ground GND for a long time, thereby further extending the discharge period of the pixel unit. As such, charge residue in each pixel unit may be avoided effectively, the liquid crystal polarization caused by the residual charge in the liquid crystal display may be reduced, occurrence of display abnormality may be avoided, a display quality of the liquid crystal display may be ensured, and the lifetime of the liquid crystal display may be improved. In addition, the turnoff discharge circuit also improves the utilization of the liquid crystal display PLG trace.

Figure 4:
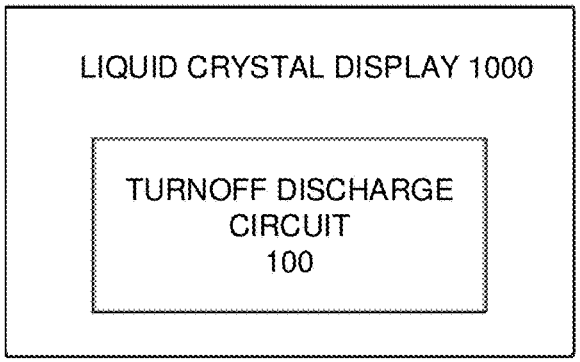
FIG. 4 is a schematic structural diagram of a liquid crystal display according to an embodiment of the present disclosure.

FIG. 4 is a schematic structural diagram of a liquid crystal display 1000 according to an embodiment of the present disclosure.

As shown in FIG. 4, the liquid crystal display 1000 includes the turnoff discharge circuit 100 as described above.

It should be noted that other structures of the liquid crystal display 1000 and functions thereof are known to the skilled in the art. No further details are provided herein to reduce redundancy.

The liquid crystal display of the embodiment of the present disclosure utilizes the turnoff discharge circuit of the liquid crystal display in the above embodiments, which may sufficiently discharge the pixel units, improve its own display quality, and increase its own service life.

Figure 5:
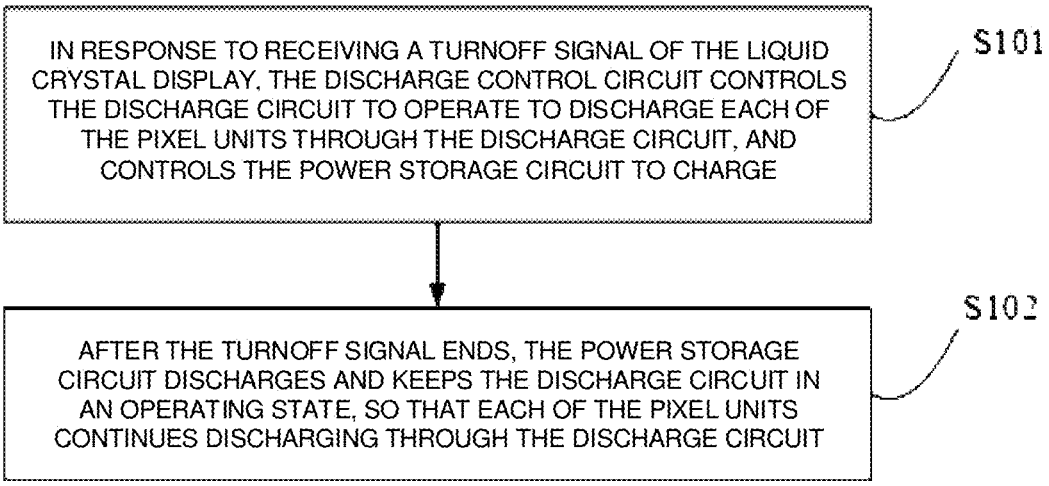
FIG. 5 is a flowchart of a method of driving a turnoff discharge circuit of a liquid crystal display according to an embodiment of the present disclosure.

FIG. 5 is a flowchart of a method of driving a turnoff discharge circuit of a liquid crystal display according to an embodiment of the present disclosure.

In the present embodiment, the turnoff discharge circuit of the liquid crystal display is the turnoff discharge circuit of the liquid crystal display in the above embodiments.

As shown in FIG. 5, the method of driving the turnoff discharge circuit of the liquid crystal display includes steps S101 and S102.

In step S101, in response to receiving the turnoff signal of the liquid crystal display, the discharge control circuit controls the discharge circuit to operate in order to discharge each pixel unit through the discharge circuit and controls the power storage circuit to charge.

In step S102, after the turnoff signal ends, the power storage circuit discharges, and keeps the discharge circuit in an operating state, so that each pixel unit continues discharging through the discharge circuit.

In an embodiment of the present disclosure, in response to receiving the display signal of the liquid crystal display, the discharge control circuit keeps the discharge circuit in a non-operating state, so as to enable the effective display area of the liquid crystal display to display normally.

Specifically, the discharge control circuit outputs a first level in response to receiving the display signal of the liquid crystal display; and outputs a second level in response to receiving the turnoff signal of the liquid crystal display.

The first level is complementary with the second level. For example, the first level is a low level, and the second level is a high level. Moreover, the setting of the first level and the second level is related to the discharge circuit in the turnoff discharge circuit of the liquid crystal display. That is, the first level should cause the discharge circuit to be in the non-operating state, so that the liquid crystal display displays normally, and the second level should cause the discharge circuit to be in the operating state, so that each pixel unit is discharged.

It should be noted that other particular implementations of the method of driving the turnoff discharge circuit of the liquid crystal display according to the embodiments of the present disclosure may refer to the particular implementation of the turnoff discharge circuit of the liquid crystal display in the above embodiments of the present disclosure, and details thereof are not described herein for simplicity.

In the method of driving the turnoff discharge circuit of the liquid crystal display according to the embodiment of the present disclosure, in response to receiving the turnoff signal of the liquid crystal display, the discharge control circuit controls the discharge circuit to operate in order to discharge each pixel unit through the discharge circuit, and controls the power storage circuit to charge; and after the turnoff signal ends, the storage circuit discharges, and keeps the discharge circuit in the operating state, so that each pixel unit continues discharging through the discharge circuit, thereby enabling the pixel units of the liquid crystal display to be sufficiently discharged, improving the display quality of the liquid crystal display and increasing the service life of the liquid crystal display.

In the description of the present disclosure, it should be understood that the terms "first" and "second" are used for descriptive purposes only, but cannot be understood as indicating or implying a relative importance or implicitly indicating the number of the technical features indicated. Thus, features defining "first" or "second" may explicitly or implicitly include at least one of the features. In the description of the present disclosure, the meaning of "a plurality of" refers to at least two, such as two, three, etc., unless specifically defined otherwise.

As used herein, the term "end" can refer to an electrical terminal. It should be understood that any mention of first or second ends, control ends, or output ends as recited herein can refer to respective terminals of electrical components.

In the present disclosure, unless otherwise specifically defined, the terms "connected", "connection" and the like are to be understood broadly, and may be, for example, a fixed connection, a detachable connection, or an integral connection; may also be a mechanical connection, or an electrical connection; may be directly connected, or indirectly connected through an intermediate medium, and may be an internal connection of two elements or an interaction relationship of two elements, unless explicitly defined otherwise. For the skilled in the art, the specific meanings of the above terms in the present disclosure may be understood on a case-by-case basis.

In the description of the present specification, the description with reference to the terms "one embodiment", "some embodiments", "example", "specific example", or "some examples" and the like means that a specific feature, structure, material or feature described in connection with the embodiment or example is contained in at least one embodiment or example of the present disclosure. In the present specification, the schematic representation of the above terms is not necessarily directed to the same embodiment or example. Furthermore, the particular features, structures, materials, or characteristics as described may be combined in a suitable manner in any one or more embodiments or examples. In addition, various embodiments or examples described in the specification and features of various embodiments or examples may be combined.

While the embodiments of the present disclosure have been shown and described above, it is understood that the above-described embodiments are illustrative but are not to be construed as limiting the scope of the disclosure. Changes, modifications, substitutions and variations may be applied by those skilled in the art to the embodiments as described above within the scope of the present disclosure.

The invention claimed is:

1. A turnoff discharge circuit of a liquid crystal display, the liquid crystal display comprising a plurality of pixel units distributed in an array, each column of pixel units being connected to a data line, the turnoff discharge circuit comprising:

a power storage circuit having a first end grounded;

a discharge circuit having a first end grounded and a second end connected to a data line corresponding to each column of the pixel units; and a discharge control circuit connected to a second end of the power storage circuit and to a control end of the discharge circuit, wherein in response to receiving a turnoff signal of the liquid crystal display, the discharge control circuit controls the discharge circuit to operate in order to discharge each of the pixel units through the discharge circuit, and controls the power storage circuit to charge, wherein after the turnoff signal ends, the power storage circuit discharges and keeps the discharge circuit in an operating state, so that each of the pixel units continues discharging through the discharge circuit.

2. The turnoff discharge circuit of the liquid crystal display according to claim 1, wherein the discharge control circuit is further configured to keep the discharge circuit in a non-operating state in response to receiving a display signal of the liquid crystal display.

3. The turnoff discharge circuit of the liquid crystal display according to claim 1, wherein the power storage circuit comprises:

a power storage capacitor, having a first end grounded and a second end connected to the discharge control circuit.

4. The turnoff discharge circuit of the liquid crystal display according to claim 2, wherein the power storage circuit comprises:

a power storage capacitor, having a first end grounded and a second end connected to the discharge control circuit.

5. The turnoff discharge circuit of the liquid crystal display according to claim 1, wherein the discharge circuit comprises:

a first discharge switch sub-circuit, having a first end grounded and a control end connected to the discharge control circuit;

a second discharge switch sub-circuit, having a first end connected to a second end of the first discharge switch sub-circuit, a second end connected to a data line corresponding to each column of the pixel units, and a control end connected to the discharge control circuit, wherein in response to receiving the turnoff signal of the liquid crystal display, the discharge control circuit controls the first discharge switch sub-circuit and the second discharge switch sub-circuit to be turned on to discharge each of the pixel units.

6. The turnoff discharge circuit of the liquid crystal display according to claim 5, wherein the plurality of pixel units distributed in the array are circularly arranged in an order of a red pixel unit column, a green pixel unit column, and a blue pixel unit column sequentially, wherein the second discharge switch sub-circuit comprises a first transistor corresponding to the red pixel unit column, a second transistor corresponding to the green pixel unit column, and a third transistor corresponding to the blue pixel unit column, wherein each of the first transistors has a first electrode connected to a data line corresponding to the red pixel unit column, a control electrode connected to the discharge control circuit, and a second electrode connected to a first node; each of the second transistors has a first electrode connected to a data line corresponding to the green pixel unit column, a control electrode connected to the discharge control circuit, and a second electrode connected to a second node; and each of the third transistors has a first electrode connected to a data line corresponding to the blue pixel unit column, a control electrode connected to the discharge control circuit, and a second electrode connected to a third node.

7. The turnoff discharge circuit of the liquid crystal display according to claim 6, wherein the first discharge switch sub-circuit comprises:

a fourth transistor, having a first electrode grounded, a second electrode connected to the second node, and a control electrode connected to the discharge control circuit;

a fifth transistor, having a first electrode grounded, a second electrode connected to the third node, and a control electrode connected to the discharge control circuit; and a sixth transistor, having a first electrode grounded, a second electrode connected to the first node, and a control electrode connected to the discharge control circuit.

8. A liquid crystal display comprising the turnoff discharge circuit of the liquid crystal display according to claim 1.

9. A method of driving a turnoff discharge circuit of a liquid crystal display, the liquid crystal display comprising a plurality of pixel units distributed in an array, each column of pixel units being connected to a data line, the turnoff discharge circuit comprising:

a power storage circuit, having a first end grounded;

a discharge circuit, having a first end grounded and a second end connected to a data line corresponding to each column of the pixel units; and a discharge control circuit, connected to a second end of the power storage circuit and to a control end of the discharge circuit, the method comprising:

in response to receiving a turnoff signal of the liquid crystal display, the discharge control circuit controlling the discharge circuit to operate in order to discharge each of the pixel units through the discharge circuit, and controlling the power storage circuit to charge; and after the turnoff signal ends, the power storage circuit discharging and keeping the discharge circuit in an operating state, so that each of the pixel units continues discharging through the discharge circuit.

10. The method of driving the turnoff discharge circuit of the liquid crystal display according to claim 9, further comprising:

the discharge control circuit keeping the discharge circuit in a non-operating state in response to receiving a display signal of the liquid crystal display.

11. The method of driving the turnoff discharge circuit of the liquid crystal display according to claim 10, wherein the discharge control circuit outputs a first level in response to receiving the display signal of the liquid crystal display; and the discharge control circuit outputs a second level in response to receiving a turnoff signal of the liquid crystal display, wherein the first level is complementary with the second level.

* * * * *